US007337850B2

(12) United States Patent
Contant

(10) Patent No.: US 7,337,850 B2
(45) Date of Patent: Mar. 4, 2008

(54) SYSTEM AND METHOD FOR CONTROLLING ACTUATION OF TOOLS IN A WELLBORE

(75) Inventor: Matthe Contant, Eindhoven (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 174 days.

(21) Appl. No.: 11/162,539

(22) Filed: Sep. 14, 2005

(65) Prior Publication Data

US 2007/0056745 A1 Mar. 15, 2007

(51) Int. Cl.
*E21B 34/10* (2006.01)

(52) U.S. Cl. ..... 166/375; 166/386; 166/66.6

(58) Field of Classification Search ..... 166/65.1, 166/66.6, 66.4, 316, 319, 386, 382, 373, 166/374, 375; 251/129.01
See application file for complete search history.

(56) References Cited

U.S. PATENT DOCUMENTS 3,780,809 A * 12/1973 Ayers et al. ..... 166/374
4,712,613 A * 12/1987 Nieuwstad ..... 166/53
5,234,057 A * 8/1993 Schultz et al. ..... 166/319
5,299,640 A * 4/1994 Streich et al. ..... 166/327
5,964,296 A * 10/1999 Ross ..... 166/373
6,012,518 A 1/2000 Pringle
6,244,351 B1 6/2001 Patel
6,547,011 B2 * 4/2003 Kilgore ..... 166/387
6,568,470 B2 * 5/2003 Goodson et al. ..... 166/66.5
6,926,089 B2 * 8/2005 Goodson et al. ..... 166/387
2002/0046845 A1 4/2002 Rayssiguier

FOREIGN PATENT DOCUMENTS

EP 0466472 A3 1/1992
EP 0604155 A1 6/1994
EP 0999343 A3 5/2000
GB 2406123 A 3/2005
WO WO 01/57358 A1 8/2001

* cited by examiner

*Primary Examiner*—Kenneth Thompson
(74) *Attorney, Agent, or Firm*—Van Someren, PC; Bryan P. Galloway

(57) ABSTRACT

A technique is provided to control operation of well tools deployed in a wellbore. The technique utilizes a completion with at least one well tool actuated by fluid input. An electronic trigger system is associated with each well tool and is designed to respond to a unique series of pressure pulses. Upon receiving the unique series of pressure pulses, the electronic trigger system actuates to enable flow of actuating fluid to the well tool for operation of the well tool.

22 Claims, 4 Drawing Sheets

SYSTEM AND METHOD FOR CONTROLLING ACTUATION OF TOOLS IN A WELLBORE

BACKGROUND

Various subterranean formations contain hydrocarbon based fluids that can be produced to a surface location for collection. Generally, a wellbore is drilled, and a completion is moved downhole to facilitate production of desired fluids from the surrounding formation. In many applications, the wellbore completion includes a hydraulic tool that is actuated by hydraulic pressure applied, for example, in the annulus surrounding the tool.

Actuation of the hydraulic tool often is controlled by using a rupture disk placed in the flow path of the hydraulic fluid that would otherwise actuate the hydraulic tool. In other words, the rupture disk is used to avoid premature actuation before a predetermined level of pressure is applied in the annulus. Once sufficient pressure is applied, the disk ruptures to create a flow path for hydraulic fluid to flow into and activate the hydraulic tool. In applications with multiple hydraulic tools, rupture disks which rupture at different pressure levels can be used to provide some individuality as to actuation of the hydraulic tools. Pressure levels within the annulus or completion tubing can be controlled by pumps disposed at a surface location.

When rupture disks are used, however, the hydraulic tool having the disk with the lowest pressure setting is always the tool that must be actuated first. Additionally, each rupture disk requires approximately a 500-1000 psi window for rupture. Thus, if multiple hydraulic tools are to be actuated at different times, multiple pressure ranges are required across a potentially large pressure spectrum. For example, if seven different rupture disks are used in a completion, a 7000 psi window above the normal hydrostatic pressure is required for dependable actuation of the corresponding hydraulic tools at the desired times.

SUMMARY

In general, the present invention provides a system and method for actuating tools used in a wellbore. One or more well tools are utilized in a completion and subject to actuation by application of a fluid through, for example, the annulus, a completion tubing or a dedicated supply line. Additionally, each well tool cooperates with an electronic trigger system designed to selectively enable flow of actuating fluid to a specific tool of the one or more well tools. The electronic trigger system is selectively actuated via a unique series of pressure pulses.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to facilitating the use of a variety of wellbore completions having one or more well tools that may be actuated by a fluid. Generally, a completion is deployed within a wellbore drilled in a formation containing desirable production fluids. The completion may be used, for example, in the production of hydrocarbon based fluids, e.g. oil or gas, in well treatment applications or in other well related applications. In many applications, the wellbore completion incorporates a plurality of well tools that may be individually actuated at desired times. In the embodiments described below, individual electronic trigger systems are operatively coupled to corresponding well tools to enable this selective actuation of each tool.

Figure 1:
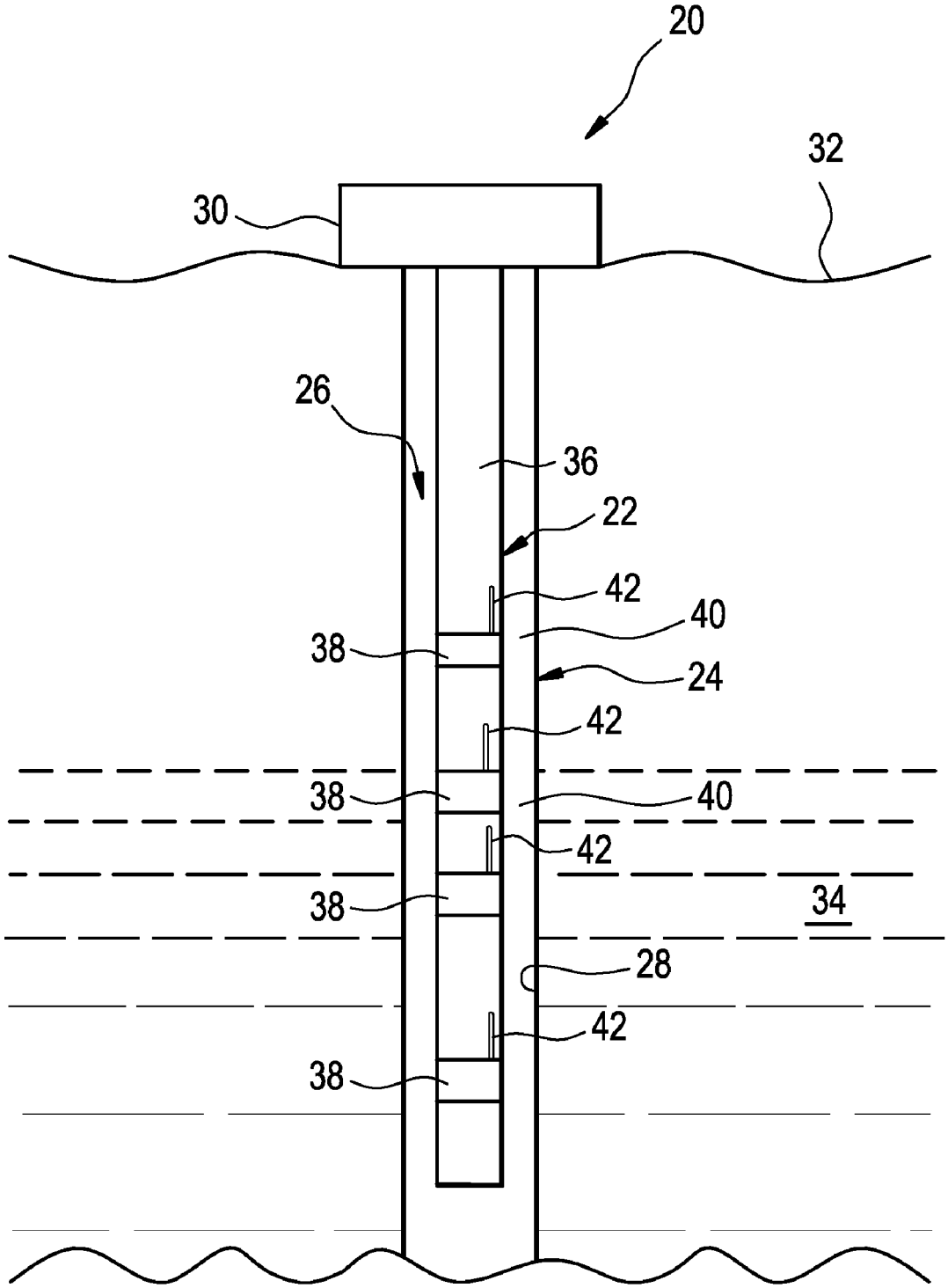
FIG. 1 is a front elevation view of a completion deployed in wellbore, according to an embodiment of the present invention.

Referring generally to FIG. 1, a well system 20 is illustrated as comprising a completion 22 deployed for use in a well 24 having a wellbore 26 that may be lined with a wellbore casing 28. Completion 22 extends downwardly from a wellhead 30 disposed at a surface location 32, such as the surface of the Earth or a seabed floor. Wellbore 26 is formed, e.g. drilled, in a formation 34 that may contain, for example, desirable fluids, such as oil or gas. Completion 22 is located within the interior of casing 28 and comprises a tubing 36 and at least one device 38, e.g. well tool, that is actuated by a fluid. In the embodiment illustrated, completion 22 has four devices 38. Depending on the design of wellbore completion 22, the actuating fluid can be directed to the well devices 38 through an annulus 40 surrounding completion 22, through tubing 36, or through a dedicated fluid conduit. In many applications, the actuating fluid is a hydraulic fluid, and devices 38 are hydraulically actuated. However, devices 38 also can be of the type used in a gas well and actuated by gas pressure.

Each device 38 is cooperatively associated with a corresponding electronic trigger system 42. In the embodiment illustrated, for example, four electronic trigger systems 42 are associated with the four devices 38 however other numbers of devices and the corresponding electronic trigger systems can be used depending on the completion design. Each electronic trigger system 42 is dedicated to a specific well device 38, e.g. to a specific well tool. The electronic trigger systems 42 enable the selective actuation of each individual device 38 when desired by the well operator. The electronic trigger systems block the flow of actuating fluid, e.g. hydraulic fluid, to the corresponding devices until it is desired to actuate the device, and thus the systems can be used with a variety of well devices. Examples of well devices 38 include, but are not limited to, samplers (e.g. a DST annular sampler), packers (e.g. a hydrostatic set packer), valves (e.g. a formation isolation valve, a bypass valve in a gravel-pack wash pipe, a ball valve, a DST reversing valve, or a flapper valve), gravel pack service tools (packers, releasing subs, circulating and reversing tools), tools used in tubing conveyed perforated devices, gun anchors or run releasing tools.

Figure 2:
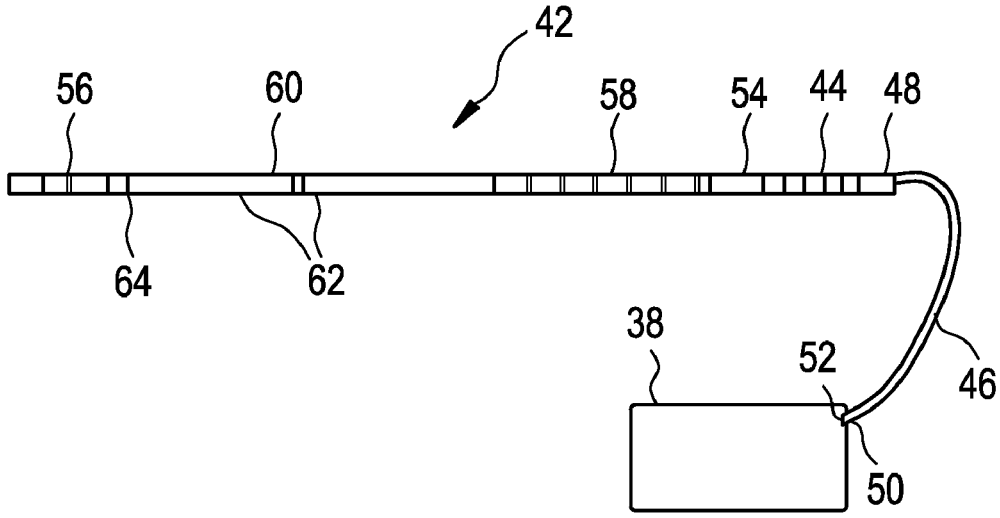
FIG. 2 is schematic illustration of an electronic trigger system connected in cooperation with a fluid actuatable well tool, according to an embodiment of the present invention.

Referring now to FIG. 2, an embodiment of one of the electronic trigger systems 42 is illustrated. In this embodiment, electronic trigger system 42 comprises a valve 44 that may be selectively moved from a closed position to an open position to enable the flow of actuating fluid to well tool 38. As illustrated, valve 44 is cooperatively engaged with well tool 38 via a fluid control line 46 coupled to the electronic trigger system 42 by a control line adapter 48. When valve 44 is in an open position, the actuating fluid can flow from a supply source external of the electronic trigger system 42, e.g. fluid disposed in annulus 40, through fluid control line 46 and into well tool 38 via an inlet port 50 for actuation of the tool. In some embodiments, well tool 38 may comprise a rupture disk 52 located in port 50, the rupture disk being designed to rupture upon the opening of valve 44 and the flow of, for example, hydraulic actuating fluid to tool 38. It also should be noted that in some system designs electronic trigger system 42 may be coupled directly to well tool 38.

Each electronic trigger system 42 further comprises an actuator 54 for selectively moving valve 44 between the closed position and the open position. In this embodiment, actuator 54 is operated in response to a unique pressure pulse signal detected at the electronic trigger system 42 by a pressure sensor 56. An electronics system 58 is used to decode the pressure pulse signal detected by pressure sensor 56 and also to initiate actuation of actuator 54 when the specific, predetermined pressure pulse signal is received. Power for the electronic system 58 and for the low power actuator 54 is supplied by an internal power source 60 formed by, for example, a battery or batteries 62.

In one embodiment, electronic system 58 may be constructed as a microprocessor-based system for control logic, as known to those of ordinary skill in the art. This type of system effectively enables downhole computer recognition of the unique signature of the pressure pulse signal associated with actuation of a specific hydraulic tool 38. The pulses are detected by pressure sensor 56 and decoded by electronics system 58 which then implements the command and control operation of actuator 54 to enable flow of actuating fluid to tool 38.

The components of electronic trigger system 42 may be assembled in a space efficient manner, depending on the specific design of the overall system 20. In the illustrated embodiment, pressure sensor 56, power source 60, electronic system 58, actuator 54 and valve 44 are assembled in a generally elongate body 64. For example, elongate body 64 may be generally cylindrical in shape with a relatively small diameter to facilitate deployment in a variety of locations, such as along completion 22. For example, elongate body 64 may be positioned along an exterior or an interior of completion 22, in the wall of completion 22, along an exterior or interior of well tool 38, or in the wall of well tool 38. In the example illustrated, elongate body 64 is generally cylindrical and has a diameter of less than 1 inch, e.g. a diameter of approximately 0.875 inch or less.

Figure 3:
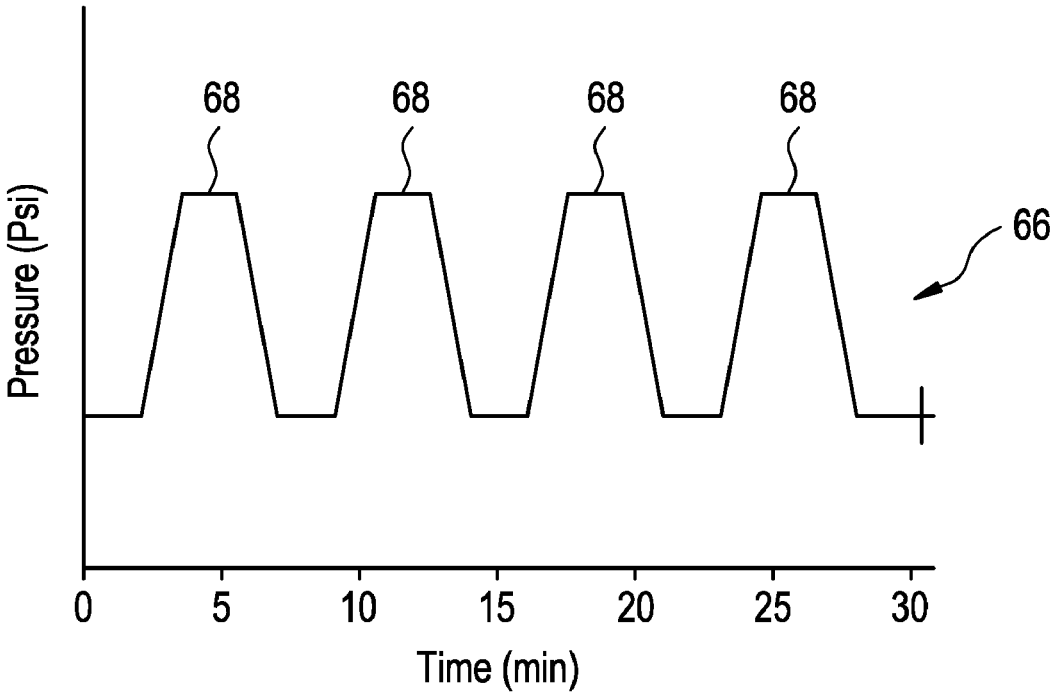
FIG. 3 is a graphical representation of one example of a pressure pulse signal that can be used to actuate a specific electronic trigger system deployed in a wellbore, according to an embodiment of the present invention.

An example of a pressure pulse signal 66 having a unique series of pressure pulses 68 is illustrated graphically in FIG. 3. The profile of pressure pulse signal 66 is selected such that the profile cannot occur during the life of the well other than when deliberately generated by, for example, surface pumps used to send the coded low-level pressure pulses through annulus 40. The pulses do not all have to be of the same amplitude or duration. The amplitude of the pulse, the duration and the number of pulses can be varied to obtain a unique series of pressure pulses. Pressure pulses 68 are detected by pressure sensor 56, and electronic system 58 is used to decode the overall pressure pulse signal 66. After the pressure pulse signal 66 has been decoded and found to be of the correct predetermined shape, e.g. as illustrated in FIG. 3, electronic system 58 causes actuator 54 to open valve 44, thereby enabling the flow of actuating fluid through inlet port 50 for actuation of well tool 38. By way of example, the flow of fluid may be a flow of hydraulic fluid to actuate a hydraulic tool 38, but it also can be a flow of high-pressure gas for actuation of a tool 38 deployed in a gas well. In the latter case, a gas system tubing and rat hole can be used to hold formation gas and/or nitrogen gas. Once the electronic trigger system is actuated, the corresponding well tool 38 is actuated by gas pressure in the well.

If a plurality of electronic trigger systems 42 are used in the completion 22 (see FIG. 1 in which completion 22 utilizes four hydraulic tools 38 and four electronic trigger systems 42), then each well tool 38 is associated with its own specific pressure pulse signal that is unique with respect to the specific pressure pulse signals associated with the other tools of the completion. Accordingly, each electronic trigger system is individually addressable without the need for separate, sequentially increasing pressure ranges. By way of example, the pressure pulse signal 66 of FIG. 3 would be associated with one electronic trigger system 42 and corresponding well tool 38, and other unique pressure pulse signals would be associated with each of the other electronic trigger systems and corresponding tools. One way of making the pressure pulse signals specific or unique with respect to each electronic trigger system is by changing the time period between pulses. For example, the time period between the last two pulses can be changed from one trigger system to the next, and electronic system 58 can be programmed to recognize these unique pressure pulse signals.

Figure 4:
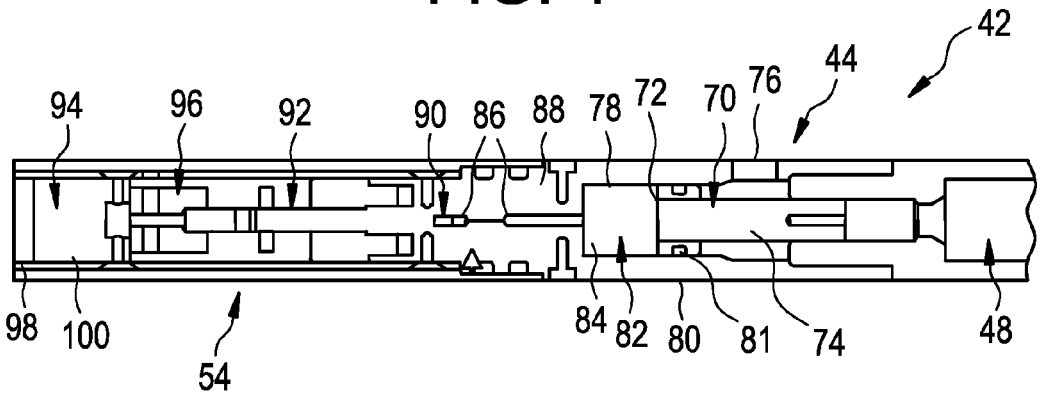
FIG. 4 is front elevation view of an embodiment of an actuator and valve system used as a component of the electronic trigger system, according to an embodiment of the present invention.

Referring to FIG. 4, an embodiment of an actuator 54 and a valve 44 is illustrated. In this example, valve 44 comprises a piston 70 having a head portion 72 and a valve portion 74. Valve portion 74 is positioned to block flow of actuating fluid, e.g. hydraulic fluid, between a hydrostatic flow port 76 and control line adapter 48 when valve 44 is in a closed position, as illustrated in FIG. 4. Hydrostatic flow port 76 serves as an inlet port for actuating fluid flowing to the corresponding well tool 38 when valve 44 is in an open position. Piston head portion 72 is slidably mounted within a cavity 78 of the surrounding valve housing 80, and a seal is created between head portion 72 and the wall forming cavity 78 by, for example, a seal member 81. A biasing mechanism 82 is used to bias piston head portion 72 towards the end of cavity 78 closest to inlet port 76. In the embodiment illustrated, biasing mechanism 82 comprises a fluid 84, such as an oil, that prevents piston 70 from moving and opening valve 44, until desired. A vent passage 86 extends through a valve body portion 88 and into fluid communication with cavity 78. When valve 44 is held in a closed position, the escape of fluid 84 through vent passage 86 is prevented by a plug 90, such as a viton plug.

The illustrated biasing mechanism is one example of a mechanism to hold piston 70 and thus valve 44 in a closed position. However, other biasing mechanisms, such as compressed gas, springs or other mechanisms able to releasably store energy, can be used to enable movement of piston 70. Also, mechanisms other than plug 90 can be used to prevent the escape of fluid 84 through vent passage 86, such mechanisms including a plug which is spring loaded or an o-ring arrangement combined with a pin that is pulled from the inside diameter of the passage.

In the embodiment of FIG. 4, plug 90 is held in place by actuator 54 until actuated. As illustrated, a lead screw 92 is positioned to hold plug 90 such that it blocks the escape of fluid from cavity 78. Lead screw 92 is coupled to a motor and gearbox unit 94 by an appropriate coupling 96. Motor and gearbox unit 94 comprises a motor 98 drivingly coupled to a gearbox 100.

Figure 5:
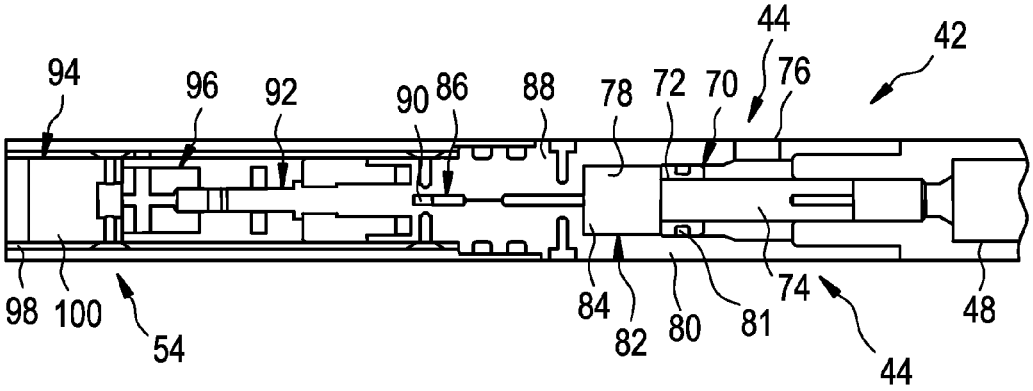
FIG. 5 is a view similar to that in FIG. 4, but showing the actuator at a subsequent state of actuation, according to an embodiment of the present invention.
Figure 6:
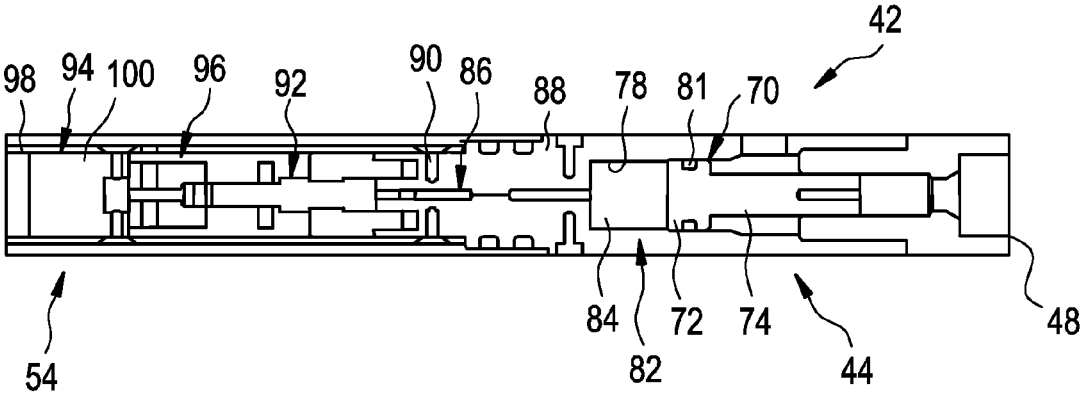
FIG. 6 is a view similar to that in FIG. 5, but showing the actuator at a subsequent state of actuation, according to an embodiment of the present invention.
Figure 7:
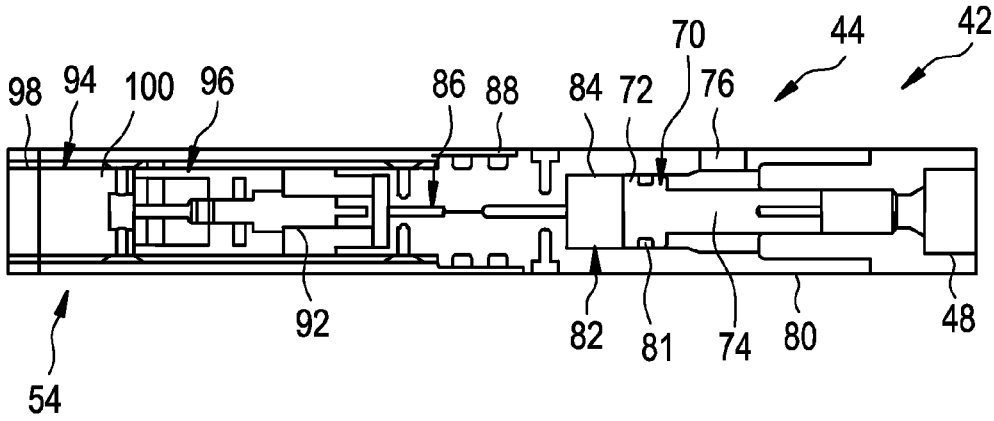
FIG. 7 is a view similar to that in FIG. 6, but showing the actuator at a subsequent state of actuation, according to an embodiment of the present invention.

When the specific pressure pulse signal is received by pressure sensor 56 and decoded by electronics system 58, the electronics system 58 then starts motor 98 which turns gearbox 100. Gearbox 100 is coupled to lead screw 92 which retracts upon rotation. Piston 70 maintains fluid 84 under pressure and, as lead screw 92 retracts, plug 90 moves under the pressure of fluid 84 acting against plug 90 in vent passage 86, as illustrated in FIG. 5. When the lead screw 92 is fully retracted, plug 90 is forced free of vent passage 86, as illustrated best in FIG. 6. Once plug 90 is free of vent passage 86, fluid 84 is continually forced through vent passage 86 by the pressure of the actuating fluid entering inlet port 76 and acting against the opposite side of piston head portion 72. As the piston 70 is forced along cavity 78, as further illustrated in FIG. 7, fluid 84 is continually metered through vent passage 86 and into, for example, an atmospheric chamber disposed on a side of valve body portion 88 opposite from cavity 78. The atmospheric chamber may be contained, for example, within the cylindrical body or other housing containing electronic system 58. Or, the housing containing the electronic system 58 can itself be used as the atmospheric chamber for venting of the fluid.

Figure 8:
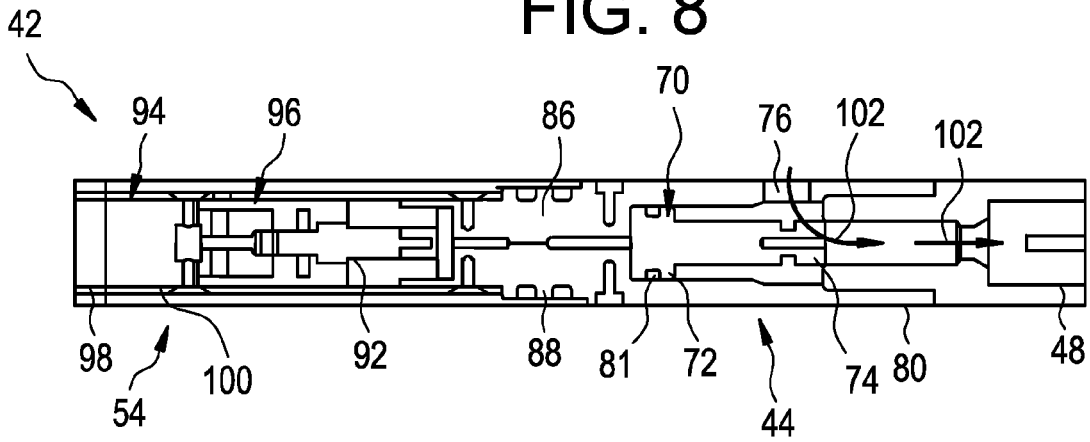
FIG. 8 is a view similar to that in FIG. 7, but showing the actuator in a fully open position enabling flow of fluid to a well tool, according to an embodiment of the present invention.

Referring generally to FIG. 8, when piston head portion 72 is forced all the way through cavity 78, valve portion 74 no longer blocks hydrostatic flow port 76, and valve 44 is in the open position. Once this occurs, actuating fluid, e.g. hydraulic actuating fluid, flows through hydrostatic flow port 76, as illustrated by arrows 102, and into inlet port 50 of well tool 38. In this example, hydrostatic pressure is applied through inlet port 50 to well tool 38 to actuate the tool. However, in an alternate embodiment, gas pressure can be used to actuate well tool 38. In completions with multiple tools 38, each of the tools can be activated at separate, specific, desired times by applying the specific pressure pulse signal associated with the corresponding electronic trigger system.

Figure 9:
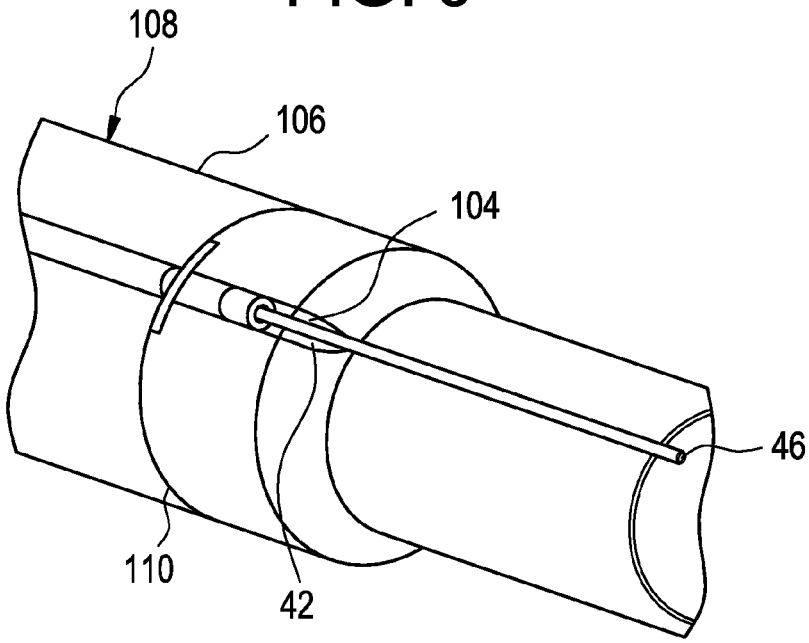
FIG. 9 is a perspective view of a mounting arrangement by which an electronic trigger system can be mounted along an exterior surface of the wellbore completion, according to an embodiment of the present invention.

Depending on the configuration of electronic trigger systems 42, the systems can be mounted in a variety of locations and to a variety of components of completion 22. In the embodiments illustrated, each electronic trigger system 42 is formed as elongate body 64, e.g. a long cylindrical body. With this design, each trigger system 42 can be deployed at least partially within a recess 104 formed, for example, along an outer surface 106 of the completion component 108, as illustrated in FIG. 9. In the one embodiment, the completion component 108 is a carrier tubing designed for coupling in axial alignment with other components of completion 22. The electronic trigger system 42 may be attached to the completion component 108, e.g. within recess 104, by an appropriate bracket 110, such as a strap. In other embodiments, the electronic trigger system may be strapped onto the outside of the tubing joint or a hydraulic tool. Also, the trigger system may be incorporated into the wall of the tubing joint or well tool, or the trigger system may be deployed on the inside of the tubing joint or well tool.

In these embodiments, valve 44 and actuator 54 require only low-power for operation, which means the battery or batteries 62 can be made relatively small. This enables creation of an electronic trigger system with a form factor, e.g. the elongate form factor described above, that is relatively easy to incorporate in a variety of completion systems for use with many types of hydraulic completion tools. Each electronic trigger system 42 can be incorporated directly into the hydraulic tool to be actuated, or it can be deployed at a separate location along the completion and coupled via control line 46 to the tool with which it is associated.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use in a wellbore, comprising:

a completion having a well tool actuated by fluid input via an input port; and an electronic trigger system coupled to the input port via a control line, the electronic trigger system being powered by a self-contained battery for actuation in response to a unique series of pressure pulses, wherein upon actuation the electronic trigger system enables flow of actuating fluid through the control line to actuate the well tool, wherein the well tool comprises a plurality of well tools and the electronic trigger system comprises a plurality of electronic trigger systems with each electronic trigger system dedicated to a corresponding well tool of the plurality of well tools.

2. The system as recited in claim 1, wherein the electronic trigger system further comprises a pressure sensor to sense the unique series of pressure pulses.

3. The system as recited in claim 2, wherein the electronic trigger system further comprises a valve mechanism to selectively enable the flow of actuating fluid through the control line to the well tool.

4. The system as recited in claim 3, wherein the valve mechanism comprises a valve body having an opening to receive fluid; and a piston mechanism disposed in the valve body, the piston mechanism movable from a closed position blocking flow through the opening to an open position allowing flow through the opening to the control line.

5. The system as recited in claim 4, wherein the piston is held in the closed position by a biasing liquid held in place by a plug.

6. The system as recited in claim 5, wherein the plug is held in place by a lead screw coupled to a gearbox which, in turn, is coupled to a motor that may be actuated to turn the lead screw and release the plug.

7. The system as recited in claim 1, wherein each electronic trigger system responds to its own specific pressure pulse signal, further wherein all the specific pressure pulse signals fall within the same pressure range.

8. A system for controlling actuation of a plurality of hydraulic tools deployed in a wellbore, comprising:

a plurality of electronic trigger systems that selectively block a supply of actuating hydraulic fluid to the plurality of hydraulic tools, each electronic trigger system being actuable, via a specific pressure pulse signal, to enable flow of actuating hydraulic fluid to a corresponding hydraulic tool, wherein each electronic trigger system is powered by its own internal power supply.

9. The system as recited in claim 8, wherein each electronic trigger system is shaped as a generally elongate cylinder having a diameter of less than 1 inch.

10. The system as recited in claim 8, wherein the specific pressure pulse signals for the plurality of electronic trigger systems all fall within the same pressure range without relying on sequentially higher pressure ranges to differentiate actuation.

11. The system as recited in claim 8, wherein each electronic trigger system is coupled to a corresponding hydraulic tool of the plurality of hydraulic tools by a control line for conducting the actuating hydraulic fluid.

12. A system for controlling actuation of a well tool deployed in a well completion, comprising:

an actuator able to selectively open flow of an actuating fluid to the well tool;

a pressure sensor to detect a specific pressure pulse signal; and an electronic system coupled between the pressure sensor and the actuator to direct operation of the actuator when the specific pressure pulse signal is detected by the pressure sensor, the actuator comprising a piston slidable between a closed position blocking flow of the actuating fluid and an open position enabling flow of the actuating fluid, wherein movement of the piston is controlled by a motor and gearbox unit.

13. The system as recited in claim 12, further comprising a battery to power the actuator.

14. The system as recited in claim 13, wherein the actuator, the pressure sensor, the electronic system and the battery are carried by a generally cylindrical body that is attachable to the wellbore completion.

15. The system as recited in claim 14, wherein the generally cylindrical body is attachable along a surface of the wellbore completion.

16. The system as recited in claim 12, wherein the piston is biased to the closed position by a biasing liquid held in place by a plug and a lead screw.

17. The system as recited in claim 16, wherein the lead screw is selectively operated by the motor and a gearbox unit to remove the plug and release the biasing liquid to allow the piston to be forced to the open position.

18. The system as recited in claim 14, further comprising a carrier member integrated into the well completion, the carrier member having a side slot for receiving the generally cylindrical body therein.

19. A method of actuating a plurality of devices in a wellbore, comprising:

deploying a completion in a wellbore, the completion having a plurality of well tools actuable via hydraulic fluid;

associating a unique pressure pulse signal with each of a plurality of electronic trigger systems;

providing each electronic trigger system with an actuator and a self-contained power source; and controlling flow of hydraulic fluid to the plurality of well tools by the plurality of electronic trigger system actuators which are independently actuable in response to the unique pressure pulse signals.

20. The method as recited in claim 19, wherein associating comprises creating a specific series of pressure pulses separated by predetermined time periods, and varying the predetermined time periods from one electronic trigger system to the next along the completion.

21. The method as recited in claim 19, wherein providing comprises providing each electronic trigger system with a battery able to power electronics for decoding the unique pressure pulse signals and able to power a motor disposed in the electronic trigger system and coupled to an actuator piston positioned to selectively enable flow of the hydraulic fluid to a specific well tool for actuation of the specific well tool.

22. The method as recited in claim 19, further comprising constructing each electronic trigger system with a pressure sensor, an electronic system, a motor, and a valve in a generally elongate body having a diameter less than 1 inch.

* * * * *